United States Patent [19]

Corbeels et al.

[11] 4,392,981

[45] Jul. 12, 1983

[54] PARTIAL OXIDATION WITH RECYCLE OF RECOVERED CARBON

[75] Inventors: Roger J. Corbeels, Wappingers Falls; Charles G. Sengenberger, Poughkeepsie, both of N.Y.

[73] Assignee: Texaco Inc., White Plains, N.Y.

[21] Appl. No.: 373,367

[22] Filed: Apr. 30, 1982

Related U.S. Application Data

[63] Continuation of Ser. No. 179,376, Aug. 18, 1980, abandoned.

[51] Int. Cl.[3] ..... C10J 3/46

[52] U.S. Cl. ..... 252/373; 48/197 R; 48/206

[58] Field of Search ..... 48/197 R, 202, 206, 48/210; 252/373; 209/166

[56] References Cited

U.S. PATENT DOCUMENTS

| | | | |
|---|---|---|---|
| 3,976,443 | 8/1976 | Paull et al. | 48/197 R |
| 4,162,966 | 7/1979 | Finly | 209/166 |
| 4,253,944 | 3/1981 | Hefner | 209/166 |

*Primary Examiner*—Peter F. Kratz

*Attorney, Agent, or Firm*—Carl G. Ries; Robert A. Kulason; Robert Knox, Jr.

[57] ABSTRACT

Unconverted char in a mixture of particles formed in the partial oxidation of an ash-containing solid fuel is recovered by grinding the mixture and subjecting the ground material to froth flotation.

4 Claims, No Drawings

PARTIAL OXIDATION WITH RECYCLE OF RECOVERED CARBON

This is a continuation, of application Ser. No. 179,376, filed Aug. 18, 1980 now abandoned.

This invention relates to the separation of inorganic material from carbonaceous material. More particularly, it is concerned with the separation of particles high in ash from particles high in carbonaceous material which particles have been produced in the partial oxidation of a solid carbonaceous fuel.

Ordinarily, in the gasification of solid fuel such as coal or coke the fuel is subjected to partial oxidation with an oxidizing agent such as air, oxygen-enriched air, or substantially pure oxygen (95%+) in a gasification zone with the production of a gas comprising carbon monoxide and hydrogen and usually also containing minor amounts of $CO_2$, $CH_4$, $H_2S$ and COS plus any nitrogen present in the oxygen-containing gas. Since ordinarily insufficient oxygen is introduced into the gasification zone for complete combustion of the carbon in the solid fuel, some of the solid fuel will proceed through the gasification zone without being converted to an oxide of carbon. When a hydrocarbon liquid is subjected to partial oxidation, the unconverted carbon appears in the product gas as fine particles of soot, whereas when solid fuel is subjected to partial oxidation the unconverted carbon appears in the product gas as fine particles of solid fuel. In addition, depending on the type of solid fuel feed, particles of ash will also appear in varying amounts entrained in the partial oxidation product gas.

When the direct quench technique is used, in order to cool the hot products leaving the gas generation zone usually at a temperature above about 1800° F. and to remove particles of ash and unconverted solid fuel entrained therein, the hot gas is introduced into a quench medium, preferably water, in a quench zone, whereby the gas is cooled and the entrained solid particles are transferred to the quench medium. The larger particles of ash or slag which are low in carbon settle to the bottom of the quench zone and are removed therefrom but the finer particles due to the agitation in the quench zone, form a suspension in the quench medium. To control the concentration of solid material in the quench medium, a portion is withdrawn continuously or periodically and is replaced with fresh quench medium. The withdrawn portion is sent to a settler where the solid particles are permitted to settle. For economic and ecological reasons, it is desirable to reuse the quench water and the unconverted solid fuel but the ash may be removed from the system.

The solids-quench medium mixture may also be produced by passing the synthesis gas i.e. the partial combustion product gas containing entrained solid particles downwardly and then abruptly changing its direction advantageously sending it to a heat recovery unit while the entrained solid particles continue on their downward path into a quiescent quench medium where most of the solids settle rapidly leaving only a minor amount of suspended fine particles which are 100% mineral matter.

As mentioned above, when the feed to the gas generation zone is a hydrocarbon liquid the unconverted carbon appears as fine particles of soot which are microscopic in size, whereas when the feed to the gas generation zone is a solid fuel the unconverted carbon is in the form of discrete particles of solid fuel. The soot formed in the gasification of a hydrocarbon liquid may be recovered from suspension in the quench water by admixture with a hydrocarbon liquid as disclosed in U.S. Pat. No. 2,992,906 to Guptill and U.S. Pat. No. 3,917,569 issued to Richter et al. Unfortunately, the unconverted particles of solid fuel do not have the affinity for hydrocarbon liquids as do the soot particles formed by the partial combustion of a liquid fuel and the separation technique used for soot recovery is unsatisfactory for the recovery of unconverted solid fuel particles from the quench water.

As stated previously, for economic reasons it may be desirable to recycle the water and the unconverted carbon to the gas generation zone, whereas it is for the most part undesirable to recycle the ash. However, since the particles range in composition from essentially 100% ash to that of the initial feed, it is desirable to separate those particles high in ash content from those high in carbon content.

It is therefore an object of this invention to separate ash from unconverted solid fuel. Another object is to obtain a high conversion to gases of the carbon in the feed solid fuel. Still another object is to minimize the amount of waste material which must be disposed of. These and other objects will be obvious to those skilled in the art from the following disclosure.

According to our invention, there is provided a process for the production of particles rich in carbon from a mixture of particles produced by the partial oxidation of a solid carbonaceous fuel which comprises grinding the particles to reduce their size and then subjecting the ground material to froth flotation treatment to produce a float fraction containing particles rich in carbon. In a preferred embodiment of the invention, those particles greater in size than 20 mesh (0.84 mm) are removed from the suspension and the remaining particles are ground and then subjected to froth flotation.

In the gasification of solid carbonaceous fuel containing ash-forming ingredients such as coal, sub-bituminous coal, lignite, petroleum coke, organic waste and the like, the solid fuel in finely divided form ground to a particle size having a maximum cross-sectional dimension not greater than about one-quarter inch and preferably ground so that at least 95% passes through a 14 mesh sieve (1.41 mm) and still more preferably so that 100% passes through a 20 mesh sieve (0.84 mm) is introduced into a free-flow, unpacked rafractory-lined gas generation zone where it is reacted with steam and oxygen. The oxygen may be in the form of air, oxygen-enriched air or substantially pure oxygen. The finely divided fuel may be introduced into the gas generation zone as a slurry in water or oil as a suspension in a gaseous or vaporous medium such a steam, $CO_2$ and mixtures thereof. In the gas generation zone the solid fuel is subjected to partial oxidation at a temperature between about 1800° and 3500° F., preferably between 2000° and 2600° F. The pressure in the gas generation zone may range between about atmospheric and 3000 psig or higher, preferably between 40 and 2500 psig. The oxygen may be introduced into the gasification zone at an oxygen:carbon atomic ratio of between about 0.7 and 1.1 preferably between 0.8 and 1.0. When the solid fuel is introduced into the gasification zone as a slurry in water advantageously the slurry should contain less than 50 weight percent water, as a water content above that value will affect the thermal efficiency of the reaction. Good results are obtained using a water to fuel weigh ratio between 0.3 and 1 preferably between 0.4 and 0.9.

In one embodiment the hot product gas containing entrained particles of ash and unconverted solid fuel is passed downwardly through a bottom outlet of the gasification chamber and into a quench chamber containing water. The hot gases are discharged through a dispersing device such as a dip tube with a serrated lower edge under the surface of the quench water and thereby cooled. In the process the entrained particles are wetted by the water and the larger particles which are generally agglomerates high in ash content decend to the bottom of the quench chamber while the remaining particles are transferred to suspension in the quench water. To provide for the removal of the more dense solid particles which are high in ash and do not remain in suspension in the quench water despite the agitation supplied by the introduction of the product gas under the surface, an outlet is located at the bottom of the quench chamber for the removal of these larger more dense particles. Preferably such particles are removed periodically by means of a lock hopper connected to the bottom outlet of the quench chamber, whereby no loss in pressure is incurred during their removal. The remaining particles of ash and unconverted fuel remain suspended in the quench medium with a portion of the suspension being removed periodically or continuously to a settling zone at the bottom of which a mixture of particles rich in carbon and particles rich in ash is formed.

In another embodiment, the entrained particles are impinged on the surface of a quiescent quench medium in which the greater portion of the particles settle leaving a suspension of extra-fine particles which are essentially 100% mineral matter.

To recover the carbonaceous material or char from the mixture of settled particles, it may first be treated to remove particles larger than 20 mesh (0.84 mm) which tend to be pure slag particles as by means e.g. of a sieve or a spiral classifier to produce a mixture containing particles no greater than 0.84 mm. These particles are then subjected to a grinding treatment to reduce their size. Preferably the particles are ground to a size less than 60 mesh (0.25 mm) and still more preferably to a size less than 100 mesh (0.149 mm). Any suitable means which provides crushing, shearing or abrading of the particles may be used. Examples of such devices are ball mills, roller mills or equipment which provides high speed agitation, whereby the particles by contact with one another are subjected to a reduction in size.

The separation of the carbonaceous material from slag is effected by froth flotation with the addition of a frothing agent to and the passage of air bubbles upwardly through a suspension of the particles. The function of the frothing agent is to produce a froth with appropriate stability. Various frothing agents may be used such as $C_5$–$C_8$ aliphatic alcohols, cresylic acids, pine oils, hydroxylated polyethers such as polypropylene glycols, methoxy tripropylene glycol and alkoxy substituted paraffins such as triethoxy butane and mixtures thereof. Froth flotation is well known in the art and does not require a detailed description here.

The following example is given for illustrative purposes only and it should not be construed that the invention is restricted thereto.

The starting material used in this example was a suspension of finely divided solid particles in water which had been formed by quenching a stream of synthesis gas produced by the partial oxidation of finely divided coal ground so that 50% passed through a 325 mesh sieve. The suspension contained about 15 wt. % solids of which 41.63 wt. % was larger than 20 mesh, 24.94 wt. % was between 20 and 60 mesh and 33.43 wt. % was less than 60 mesh. A sample of the suspension was screened using a 20 mesh sieve and a portion of the suspension containing the −20 mesh particles to which 0.25 vol. % methyl isobutyl carbinol was added, was treated in laboratory flotation apparatus (Denver Equipment Company, Model D-1). After mixing for a few seconds, air was allowed to be aspirated into the test cell by the propeller. A froth formed which flowed over the rim of the cell into a receiver. The froth initially entrained a large number of particles and then rapidly became particle free. The results are shown below in Table 1, Run 1.

Two separate samples of the screened suspension were agitated in a high speed kitchen blender, one for ten seconds and the other for one minute. The samples were then treated to the same froth flotation as in Run 1. The results are reported as Runs 2 and 3 in Table I, Run 2 being that run where the suspension was subjected to ten seconds in the blender and Run 3 being that run where the suspension was subjected to one minute in the blender.

Runs 4 and 5 appearing in Table I below are substantially identical. In each of these runs a sample of the screened suspension, ball milled until all of the particles were less than 100 mesh in size, was subjected to the same froth flotation treatment as Runs 1, 2 and 3.

TABLE I

| Run No. | Float Fraction % Ash | Residue Fraction % Ash | % Recovery of Char In Float |
|---|---|---|---|
| 1 | 43.5 | 62.3 | 58.4 |
| 2 | 45.0 | 73.7 | 85.0 |
| 3 | 35.6 | 89.4 | 93.9 |
| 4 | 30.4 | 100.0 | 100.0 |
| 5 | 28.0 | 96.8 | 97.3 |

These results clearly show the beneficial effect of grinding the suspended particles prior to froth flotation both in terms of char recovery and char quality.

Not only may the process of our invention be used in the conventional operation of a coal gasifier but it also permits the use of lower oxygen rates without any loss in the overall conversion. With the reduced oxygen input, the gasifier is operated at a lower temperature which is less detrimental to the refractory lining, but with the recycle of the unconverted char, the overall conversion suffers no loss. The invention also serves to reduce the ash concentration in the recycled material.

Various modifications of the invention as herein before set forth may be made without departing from the spirit and scope thereof, and therefore, only such limitations should be made as are indicated in the appended claims.

We claim:

1. In a process for the gasification of a finely divided solid fuel entrained in a fluid medium which comprises subjecting a finely divided solid fuel ground so that at least 95% passes through a 14 mesh sieve to partial oxidation to produce a gas comprising carbon monoxide and hydrogen and containing carbon and ash bearing entrained particles and recycling said entrained particles to the partial oxidation step wherein the improvement comprises removing the entrained particles in a liquid quench medium, settling the carbon rich portion of said particles in said liquid medium, rejecting particles larger than about 0.84 mm from the settled particles and comminuting the remaining particles, subjecting the comminuted particles to froth flotation and recycling only the carbon rich float fraction to the partial oxidation step.

2. The process of claim 1 in which 100% of the finely divided solid fuel passes through a 20 mesh sieve.

3. The process of claim 1 in which the remaining collected particles are ground to a size less than 60 mesh.

4. The process of claim 1 in which the remaining collected particles are ground to a size less than 100 mesh.

* * * * *